United States Patent [19]

Helton et al.

[11] Patent Number: 4,496,438

[45] Date of Patent: Jan. 29, 1985

[54] BATH COMPOSITION AND METHOD FOR COPPER-TIN-ZINC ALLOY ELECTROPLATING

[75] Inventors: Raymond L. Helton; Douglas W. Trobough, both of Beaverton; Marianne McPherson, Portland, all of Oreg.

[73] Assignee: Tektronix, Inc., Beaverton, Oreg.

[21] Appl. No.: 508,292

[22] Filed: Jun. 24, 1983

[51] Int. Cl.[3] ..... C25D 3/58

[52] U.S. Cl. ..... 204/44

[58] Field of Search ..... 204/44, 123, 43 S, 43 Z

[56] References Cited

FOREIGN PATENT DOCUMENTS 62191 10/1980 Japan ..... 204/44

OTHER PUBLICATIONS

G. F. Jacky, Plating, vol. 58, No. 9, pp. 883–887, Sep. 1971.

*Primary Examiner*—G. L. Kaplan

*Attorney, Agent, or Firm*—John Smith-Hill

[57] ABSTRACT

An alkaline, cyanide, aqueous electroplating composition of copper, tin, and zinc includes a small amount of nickel to enhance the inclusion of tin in the copper-tin-zinc plate deposited from the solution. The plate resists tarnishing by a corrosion test solution, and retains its bright silvery-colored appearance because the plate preferably includes at least about 10.9 atomic wt % tin. The plating method for enhanced tin alloys through nickel additions to the bath is also described.

22 Claims, No Drawings

BATH COMPOSITION AND METHOD FOR COPPER-TIN-ZINC ALLOY ELECTROPLATING

DESCRIPTION

1. Technical Field

The present invention relates to an electroplating bath composition; more particularly, to an alkaline, cyanide, aqueous electroplating solution for plating an alloy of copper-tin-zinc. The composition of tin in the alloy is enhanced by the addition of small amounts of nickel to the bath.

2. Background Art

G. F. Jacky described the electroplating of copper-tin-zinc alloy in September 1971 *Plating and Surface Finishing* at 883–887. A practical implementation of the Jacky bath included:

$Cu^{+}$ 0.40–0.48 oz/gal
$Zn^{+2}$ 0.18–0.22 oz/gal
$Sn^{+4}$ 0.15–0.20 oz/gal
NaCN 2.7–3.1 oz/gal
$Na_2CO_3$ 4.0–10 oz/gal, had a pH of between 12.3–12.7, and was used for electrodeposition of a bright ternary alloy with a composition generally in the range of 50–60 wt % copper, 20–30 wt % tin, 15–25 wt % zinc, when plated at current densities of 5–45 ASF and temperatures of 120°–180° F. without the addition of the organic brightener. A small amount of 50% $H_2O_2$ was added to the bath to oxidize the tin to the +4 (stannic) valence state.

Products plated with the Jacky bath or its close equivalent were found to encounter severe tarnishing problems as they underwent a cleaning step prior to soldering. The plated parts turned brown if the plate had less than about 10.9 atomic wt % tin (about 18.7 wt %). Parts found to have a higher atomic wt % tin when analyzed with Auger spectroscopy remained untarnished. Parts with a slight discoloration had a tin content close to the 10.9 atomic wt % tin. To ensure desired corrosion resistance and to achieve desired aesthetic qualities of the plated parts, it was important to find a method for plating which would ensure that the copper-tin-zinc alloy would have at least 10.9 atomic wt % tin when plated. In this regard, the Jacky bath was unsatisfactory, in that it could not be controlled to obtain plated products having the targeted cooper-tin-zinc alloy content.

DISCLOSURE OF INVENTION

The present invention generally is used for plating an alloy of copper, tin, and zinc. The preferred electroplating bath composition includes a predetermined amount of copper, tin, and zinc ions, and an effective amount of nickel ions sufficient to promote the plating of a corrosion-resistant, bright silvery-colored plate of copper-tin-zinc alloy. Preferably, the alloy should have at least 10.9 atomic wt % tin, and is electrodeposited from an alkaline, cyanide, aqueous electroplating bath. Nickel is added to the bath to enhance the inclusion of tin within the plate alloy and is added at a concentration between about 12.0 to 20.0 ppm (weight/volume). The process of plating a corrosion-resistant, bright silvery-colored, copper-tin-zinc alloy by adding an effective amount of nickel ions to the electroplating bath composition is also claimed. Finally, the invention claims the corrosion-resistant, bright silvery-colored alloy plate deposited as the product of the process.

BEST MODE FOR CARRYING OUT THE INVENTION

An improved copper-tin-zinc electroplating bath composition is prepared by dissolving the following compounds in water heated to 140° F. (60° C.):

1. 4.0 oz/gal sodium cyanide
2. 0.71 oz/gal sodium hydroxide
3. 0.33 oz/gal zinc cyanide
4. 0.58 oz/gal copper cyanide
5. 2.60 oz/gal sodium carbonate
6. 0.41 oz/gal sodium stannate
7. 0.004 oz/gal nickel acetate Each compound is dissolved in the order listed, using about $\frac{3}{4}$ of the final solution volume and allowing each compound to completely dissolve between additions. Usually, two minutes are allowed between additions, with good agitation of the bath during the dissolving stages. After the final addition of nickel acetate, water is added to reach the final volume. The bath is then heated to about 150° F. (66° C.) before use. For rack plating, a current density of between about 2–10 ASF, preferably 4 ASF (amps/ft$^2$), is used. For barrel plating, a current density of between about 8–15 ASF, preferably 10 ASF, is used. The preferred current density is dependent upon the actual conditions of the bath.

The initial volume and temperature of the bath is not critical. The order of addition is somewhat more critical, and it is preferred to add the chemicals serially in the order listed. Other orders may also work.

The addition of sodium carbonate appears to be optional. Since sodium carbonate is a by-product of the plating process, it appears in the bath during plating. It may be omitted from the solution in a barrel plating line, but is generally added for rack plating.

The preferred electroplating bath composition has the following control limits for critical compounds:

TABLE

| | | Range | Optimum |
|---|---|---|---|
| $Cu^{+}$ | | 0.40–0.48 oz/gal | 0.44 oz/gal |
| $Zn^{2+}$ | | 0.18–0.22 oz/gal | 0.20 oz/gal |
| $Sn^{4+}$ | | 0.15–0.20 oz/gal | — |
| NaCN | | 3.1 –3.5 oz/gal | 3.5 oz/gal |
| NaOH | (Rack) | 0.60–0.75 oz/gal | 0.71 oz/gal |
| | (Barrel) | 0.55–0.65 oz/gal | 0.60 oz/gal |
| $Ni^{+}$ | | 12–20 ppm | — |

The bath aims at obtaining an alloy of 60–70 wt % copper, 20–30 wt % tin, and 5–10 wt % zinc, by Auger analysis using pure metal standards. If the [$Sn^{4+}$] is at the low end of its range and [$Ni^{+}$] is at the high end of its range, the appearance of the plate may be adversely affected.

Test plates run on a slightly modified bath composition having 30 ppm nickel produced a tarnished brown plate in areas of high current density. This plate was analyzed to find a relatively large amount of nickel in the plate alloy. Apparently, the high nickel concentration in the bath interferred with the deposition of tin and led to the appearance of a brown plate due to the lower tin concentration in the plate. By microprobe analysis, the brown plate had the following relative weight percents:

Cu: 48.0%
Sn: 13.5%
Zn: 32.5%
Ni: 6.0%

The average of the microprobe readings for the bright plate area of the same cell had the following relative weight percents:

Cu: 50%
Sn: 32%
Zn: 17%
Ni: 1%

This 30 ppm nickel bath had the cyanide content controlled at 2.7–3.1 oz/gal, and a pH of 12.4–12.7. Eight ml/gal 50% $H_2O_2$ were added after makeup of the bath. No nickel acetate was added, but nickel was present in the bath because of sulfamate nickel bath contamination from an earlier process. The content of nickel was measured by atomic absorption spectroscopy and found to be 30 ppm.

A test for good and bad electroplated parts was developed wherein a test plate was soaked in a solution of 10 g/l $NaClO_2$, 3.5 g/l NaOH, and 1.8 g/l $Na_3PO_3$ for 60 seconds at 170±5° F. Bad parts would visibly tarnish during this test. This solution tests for corrosion resistance on an accelerated basis and determines low tin alloy content in the plate.

Several tests were run with the barrel plate makeup solution of the nature already described for the preferred bath in a standard barrel plating process. The concentration of nickel acetate in the solutions was varied to determine its effect. The results of those tests are as follows:

| Nickel Concentration (ppm) | Corrosion Resistance |
|---|---|
| 6.4 | Bad |
| 7.2 | Bad |
| 9.6 | Fair |
| 9.8 | Fair |
| 11.0 | Bad |
| 12.0 | Good |
| 14.7 | Good |
| 15.7 | Good |
| 15.8 | Good |
| 16.0 | Good |
| 16.0 | Good |
| 17.0 | Good |
| 20.0 | Good |
| 30.0 | Bad |

The plates were judged on a good/bad basis for tarnishing when soaked in the corrosion test solution already described. These tests show that between 12 ppm and 20 ppm nickel added to the electroplating bath produces the desired corrosion resistance, presumably by enhancing the tin content of the copper-tin-zinc alloy plated. Good test plates had more than 10.9 atomic wt % tin in their alloys. As little as 9.6 ppm nickel produced fair results, which were better than the Jacky-type plating bath.

Between May 4, 1982 and June 30, 1982, parts plated with the Jacky-type bath composition were tested for corrosion resistance and passed only if tarnishing did not occur. Few parts passed, and those that did were generally plated soon after makeup of the bath. During this two-month period, the bath was remade 34 times in an attempt to achieve the desired copper-tin-zinc plate.

The composition of the present invention enables production of good parts most of the time. If failure is discovered, the bath composition can be adjusted with nickel and tin additions by Hull cell to bring the parts back to acceptable quality.

A bath of the preferred composition has made acceptable parts for up to five months without significant loss of quality. Nearly all plated parts are acceptable. Thus, by adding small amounts of nickel to the bath, surprising results are achieved. Severe production problems have virtually disappeared.

Although nickel acetate is a preferred additive, nickel sulfamate, nickel chloride, or another nickel compound with a benign anion may be used to add the desired amount of nickel to the bath. For example, nickel-containing, cadium plating brighteners may be used if the concentration of nickel can be measured and if the addition will not poison the bath.

Although the mechanism of the enhancement of tin inclusion in the plate by the addition of small amounts of nickel to the bath is not well understood, the nickel apparently enhances the polarization of tin while it depresses the polarization of zinc, thereby leading to tin's enhanced plating. This effect of nickel on tin and zinc is expected to be effective in other tin and zinc alkaline alloy baths, such as tin-zinc, copper-tin, copper-zinc, and copper-tin-zinc compositions for different plates than those preferred in this invention.

We claim:

1. An electroplating bath composition for plating an alloy of copper, tin, and zinc, wherein the alloy plate is corrosion-resistant and bright silvery colored, comprising the alkaline, cyanide aqueous solution made by dissolving about:

4.0 oz/gal NaCN;
0.71 oz/gal NaOH;
0.33 oz/gal $ZnCN_2$;
0.58 oz/gal CuCN;
0.41 oz/gal sodium stannate; and
0.004 oz/gal nickel acetate in water.

2. The composition of claim 1, further comprising about 2.6 oz/gal sodium carbonate.

3. The composition of claim 2 wherein the solution is made up by adding the components serially in the following order, namely NaCN, NaOH, $Zn(CN)_2$, CuCN, sodium stannate, sodium carbonate and nickel acetate.

4. The composition of claim 3 wherein the solution is well agitated for about two minutes between additions and the temperature of the water during the makeup is about 140° F. (60° C.).

5. An electroplating bath composition for plating an alloy of copper, tin, and zinc, comprising an aqueous solution containing about 0.40–0.48 oz/gal $Cu^+$
0.18–0.22 oz/gal $Zn^{2+}$
0.15–0.20 oz/gal $Sn^{4+}$
0.004 oz/gal nickel acetate
0.55–0.75 oz/gal NaOH
3.1–3.5 oz/gal NaCN.

6. The composition of claim 5 wherein the solution is buffered with a predetermined amount of carbonate.

7. An electroplating bath composition for plating an alloy of copper, tin, and zinc, comprising an alkaline, cyanide, aqueous solution containing about 0.40–0.48 oz/gal $Cu^+$
0.18–0.22 oz/gal $Zn^{2+}$
0.15–0.20 oz/gal $Sn^{4+}$
0.1–3.5 oz/gal NaCN
0.55–0.75 oz/gal NaOH and about 12–20 ppm nickel ions, made available in the form of nickel acetate, to promote the plating of a corrosion-resistant, bright silvery-colored plate of copper-tin-zinc alloy having a tin concentration of at least about 10.9 atomic wt % tin and being resistant to tarnishing by soaking in a solution of 10 g/l $NaClO_2$, 3.5 g/l NaOH, and 1.8 g/l $Na_3PO_3$ for 60 seconds at 170±5° F.

8. The composition of claim 7 wherein the solution contains a predetermined amount of carbonate buffer.

9. The composition of claim 7 wherein the solution contains about 0.004-oz/gal nickel acetate.

10. A method of preparing an electroplating bath, comprising dissolving NaCN, NaOH, Zn $(CN)_2$, CuCn, sodium stannate and nickel acetate in water in proportions such as to produce an aqueous solution containing about 0.40–0.48 oz/gal $Cu^+$
0.18–0.22 oz/gal $Zn^{2+}$
0.15–0.20 oz/gal $Sn^{4+}$
12.0–20.0 ppm nickel ions
0.55–0.75 oz/gal NaOH
0.1–3.5 oz/gal NaCN.

11. A method according to claim 10, wherein about 4.0 oz/gal NaCN;
0.71 oz/gal NaOH;
0.33 oz/gal Zn $(CN)_2$;
0.58 oz/gal CuCN;
0.41 oz/gal sodium stannate; and
0.004 oz/gal nickel acetate are dissolved in water to produce the aqueous solution.

12. A method according to claim 11, wherein the solution further comprises about 2.6 oz/gal sodium carbonate.

13. A method according to claim 12, wherein the components are added serially in the following order, namely NaCN, NaOH, $Zn(CN)_2$, CuCn, sodium stannate, sodium carbonate and nickel acetate.

14. A method according to claim 13, wherein the temperature of the water during the makeup is about 60° C. and the solution is agitated for about two minutes between additions.

15. An electroplating bath composition for plating an alloy of copper, tin, and zinc, comprising a solution having a predetermined amount of copper, tin and zinc ions and an effective amount of nickel ions, available in the form of nickel acetate present in a concentration of about 0.004 oz/gal, sufficient to promote the plating of a corrosion-resistant, bright silvery-colored plate of copper-tin-zinc alloy.

16. The composition of claim 15, wherein the solution contains between about:

0.40–0.48 oz/gal $Cu+$
0.18–0.22 oz/gal $Zn^{2+}$
0.15–0.20 oz/gal $Sn^{4+}$.

17. The composition of claim 16 wherein the solution further contains between about 0.55–0.75 oz/gal NaOH.

18. An electroplating bath composition for plating an alloy of copper, tin, and zinc, comprising an alkaline, cyanide, aqueous solution having between about 0.40–0.48 oz/gal $Cu^+$, 0.18–0.22 oz/gal $Zn^{2+}$, and 0.15–0.20 oz/gal $Sn^{4+}$, and said composition also containing between about 12.0–20.0 ppm nickel ions, made available in the form of nickel acetate.

19. A method for plating a corrosion-resistant, bright silvery-colored plate utilizing as an electroplating bath composition an alkaline, cyanide, aqueous solution of copper, tin and zinc having a temperature of 140° F., said method comprising adding to the electroplating bath composition, after addition of all other ions to the composition, an effective amount of nickel ions in the form of nickel acetate to promote plating of a copper-tin-zinc alloy.

20. The method of claim 19 wherein the concentration of nickel is between about 12–20 ppm.

21. The method of claim 20 wherein the composition has a concentration of between about 0.15–0.20 oz/gal tin.

22. A method for enhancing the inclusion of tin in a copper-tin-zinc alloy formed from an alkaline, cyanide aqueous solution, comprising the step of:

adding to the solution, after all other additions a sufficient amount of nickel, in the form of nickel acetate, to provide a concentration of nickel between about 12–20 ppm, whereby formation of a plate of copper-tin-zinc alloy having at least about 10.9 atomic wt % tin, and having a bright silvery-colored surface, is promoted.

* * * * *